United States Patent [19]

Goffredo

[11] 4,017,982

[45] Apr. 19, 1977

[54] DRYING APPARATUS

[75] Inventor: Daniel L. Goffredo, Riverton, N.J.

[73] Assignee: Chemcut Corporation, State College, Pa.

[22] Filed: July 28, 1975

[21] Appl. No.: 599,597

[52] U.S. Cl. ..... 34/31; 34/23; 34/66; 34/148; 34/151; 15/306 R

[51] Int. Cl.[2] ..... F26B 3/04

[58] Field of Search ..... 34/160, 23, 31, 33, 34/151, 162, 228, 232, 66, 216, 217, 68, 69, 148; 15/306 A, 306 B, 306 R; 134/64 R, 64 P, 122 R, 122 P

[56] References Cited

UNITED STATES PATENTS

| | | | |
|---|---|---|---|
| 2,060,430 | 11/1936 | Spooner | 34/23 |
| 3,367,044 | 2/1968 | Fitch | 34/216 |
| 3,405,456 | 10/1968 | Shepherd | 34/155 |
| 3,579,853 | 5/1971 | Martino | 34/160 |
| 3,801,387 | 4/1974 | Goffredo | 134/198 |

*Primary Examiner*—John J. Camby
*Assistant Examiner*—Larry I. Schwartz
*Attorney, Agent, or Firm*—Paul & Paul

[57] ABSTRACT

Apparatus is provided for drying articles that have been treated, for example, with an etchant or other treatment fluid and then washed, in order to remove the liquid, generally water, therefrom, the apparatus employing a conveyor for conveying the articles through a chamber, with a plurality of gas knives for preferably engaging the wet articles with a stream or curtain of cool air for physically impelling most of the liquid, generally water, from the articles, followed by delivering the articles past one or more other gas knife stations whereby air that has been heated is impelled onto the articles, for removing generally water film from the surface thereof. The apparatus is adjustable for using a single blower to provide originally unheated air to a single duct that is bifurcated into two channels, with a heater being provided in one of the channels.

5 Claims, 4 Drawing Figures

DRYING APPARATUS

BACKGROUND OF THE INVENTION

In the chemical processing by many types of apparatus, such as in etching systems, the articles to be treated are subject to an etching process, often generally followed by a washing process. Similarly, as part of an etching system, a masking process may be utilized, which will also be generally followed by a washing process. Where etching is done, it will often be accomplished by treating unmasked portions of printed circuit boards or the like with an acid such as ferric chloride or the like. For purposes of this invention, all acids, resists, rinse waters or other solutions will be encompassed within the term "liquid," although most generally the liquid to be removed from and dryed from the articles will comprise water, in whole or in part.

Also, in accordance with the broad aspects of this invention, while the apparatus is particularly adaptable for drying printed circuit boards and like elements, other elements, such as printed circuit film, and even articles that are not related to printed circuit boards may be dried in accordance with an apparatus as described herein.

In accordance with the prior art, it is known to pass articles being treated through a chamber on a conveyor mechanism, and to utilize air knives as a form of gas knife means, in order to blow or impel liquid from the articles. An example of this is taught in U.S. Pat. No. 3,301,387, and to some extent in the art cited therein.

It is also known in the art to dry by blowing air taken from the environment of the room in which the apparatus is located, through three pairs of air knives, for the purpose of chasing water off the surface of the article. This yields an article that to appearances is dry, but does contain condensed moisture because of the ambient air in the room, which may have been very close to the dew point. Dryers of this prior art type are therefore limited such that the effectiveness of drying is dependent upon the relative humidity of the ambient air that is fed to the air knives. Thus, the effectiveness of a dryer can vary depending upon its location geographically, weather conditions at any given time of the year, and various other factors that can affect the relative humidity in the environment of utilization of the apparatus.

SUMMARY OF THE INVENTION

The present invention is directed toward providing an apparatus that drys by employing the principles of providing an air screen or the like for impelling liquid from articles being dried, by the use of cooler air, and which additionally employs heated air directed at the articles after they pass the original set of air knives that applies the cooler air. The heated air keeps the relative humidity close to the articles sufficiently low to facilitate evaporation of residual liquid on the articles, and also to prevent droplet formation from any high humidity that may exist in the chamber beyond the cool air knives, from condensing on the surfaces of the articles that have been subjected to the cooler air. The air that is supplied to the warmer air knives is pre-heated by means of a heater preferably located in the duct that supplies the air. Air is delivered to the duct by a blower of the fan type or the like, and diverted by means of an adjustable deflection plate into one of two channels; with one channel directing some of the air to the initial air knives (cooler air knives) that effect a blowing-off of liquid from the articles, and with the other channel directing air across or pass the heater, to the air knives that provide the warm drying.

This permits the cool air to chase the water droplets from the work pieces or other articles. However, as the articles pass the initial cool air knives, any residual condensed water film on the surface will be dried to a moisture free condition as these wet surfaces pass the hot air knives.

Both steps; i.e., the provision of cooler air knives and the use of the hot air knives are needed to effectively cause the desired drying. If, in the alternative, all of the air knives provided heated air, then an undesirable effect may be obtained in that water droplets would be dried while still on the surface of the articles and the combined actions of the hot air, cold water and any residual solids within the water droplets may cause galvanic oxidation as well as water spotting. Accordingly, in accordance with the present invention the apparatus provides a means for wiping the water off the boards initially by the cool air application, followed by hot air drying of any residual film, thereby providing a clean reliable surface suitable for receiving, for example, electronic connections if the articles are printed circuit boards or the like, as well as providing an aesthetically acceptable finish and eliminating galvanic oxidation and water spotting.

A further advantage of the present invention resides in efficient utilization of the preferably electrical energy that provides the heat for the air being delivered to the hot air knives, thereby not wasting heat by applying it to the initial air knives that effect the blowing-off. This allows conservation of as much as one third of the electrical energy used to heat the air that finalizes the drying. Additionally, unnecessary utilization of heat for evaporation of the initial water droplets on the articles is avoided and maximum efficient use of the heat for drying residual water film by convection and conduction is effected.

Accordingly, it is a primary object of this invention to provide a novel article drying apparatus.

It is a further object of this invention of accomplish the above object wherein efficient utilization of heat is effected.

It is another object of this invention to accomplish the above objects, wherein liquid droplets are blown off articles being treated by moving those articles through an air screen of unheated air, and with heated air applied through one or more additional air screens being utilized to complete the drying process by evaporation of any residual film or moisture on the articles.

It is a further object of this invention to accomplish the above object, wherein ambient air is efficiently diverted, some to an initial air knife device, and some to a delivery zone having a heater therein, for heating air provided to one or more other air knives.

It is another object of this invention to accomplish the above object, wherein means for adjusting the amount of air between the cooler and the warmer air knives is provided, such adjustment preferably being from outside the apparatus for readily being altered or adjusted by an operator.

It is another object of the present invention to provide a novel method of drying printed circuit boards and other articles being treated.

Other objects and advantages of the present invention will be readily apparent to those skilled in the art from a reading of the following brief descriptions of the drawing figures, detailed description of the preferred embodiments, and the appended claims.

BRIEF DESCRIPTIONS OF THE DRAWING FIGURES

DETAILED DESCRIPTION OF PREFERRED EMBODIMENTS

Figure 1:
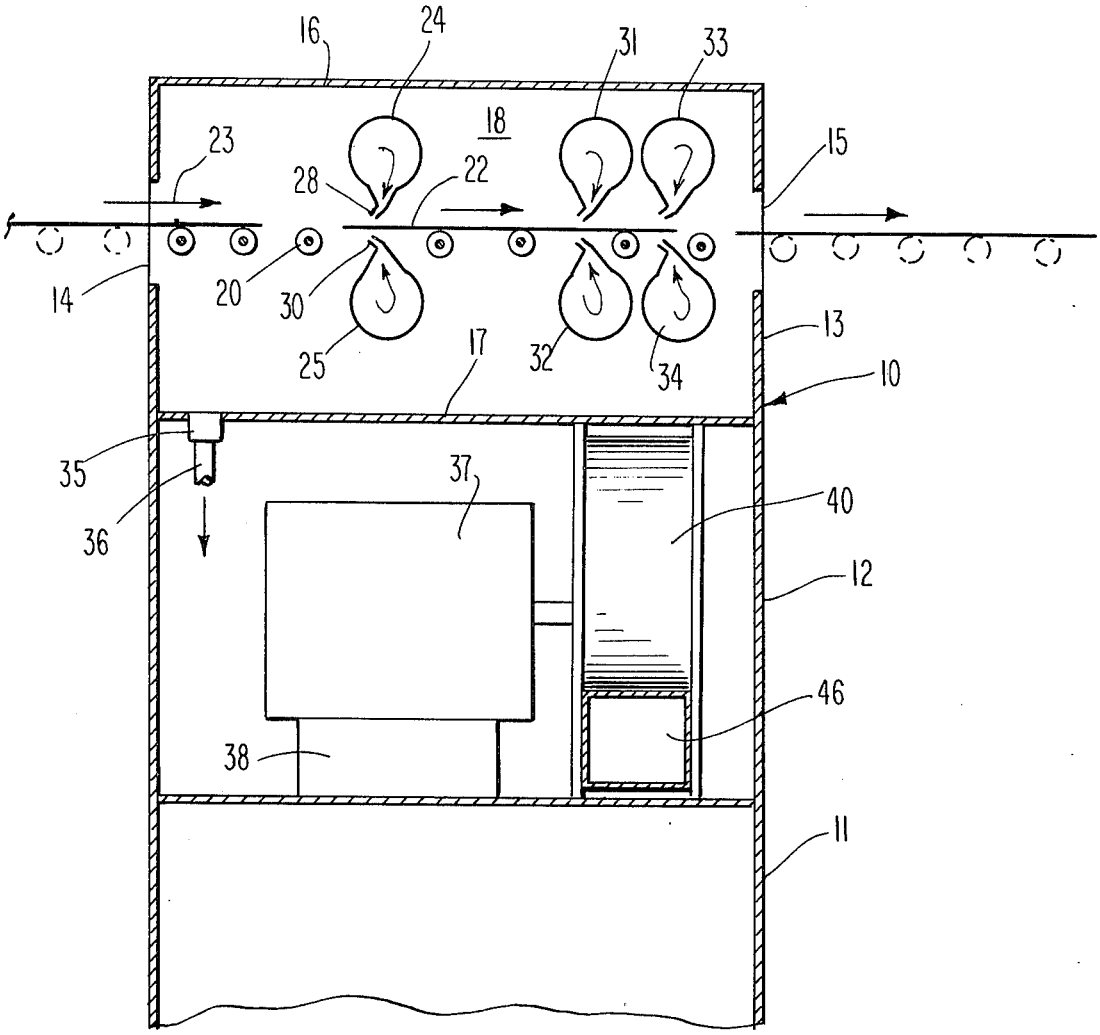
FIG. 1 is a vertical sectional view, taken through the upper end of an apparatus of this invention, with portions of the base of the apparatus being broken away in the interest of clarity, and wherein the direction of flow of articles through the chamber of the apparatus, as well as the direction of flow of air through air knives is best illustrated.

Referring now to the drawings in detail, reference is first made in FIG. 1, wherein the drying apparatus is generally designated by the numeral 10, as comprising a base portion 11, the bottom of which is broken away for clarity, the lower end of the apparatus being constructed generally similar to the lower end of the apparatus of U.S. Pat. No. 3,801,387, the disclosure of which is herein incorporated by reference, a middle portion 12, and an upper chamber portion 13.

The chamber portion 13 is provided with an inlet opening 14 extending across the chamber 13, into and out of the plane of the paper, and a similar exit opening 15 at the opposite end. The chamber is provided with an upper end or cover 16, and a floor 17, to create a relatively confined zone 18 within the chamber to prevent splashing and the like as well as to prevent contamination of articles being treated by the apparatus 10 from outside the apparatus.

A plurality of conveyor rollers 20 are provided, rotatable in a clockwise direction as viewed in FIG. 1, for delivery of articles 22 in the rightward direction illustrated for the arrows 23 in FIG. 1, the conveyor rollers 20 being mounted on a shaft that in turn is driven preferably from an end of the apparatus 10, such driving mechanism not being illustrated herein.

Articles 22 thus pass into the chamber 13, for delivery in a forward direction through the chamber to the discharge opening 15.

Figure 3:
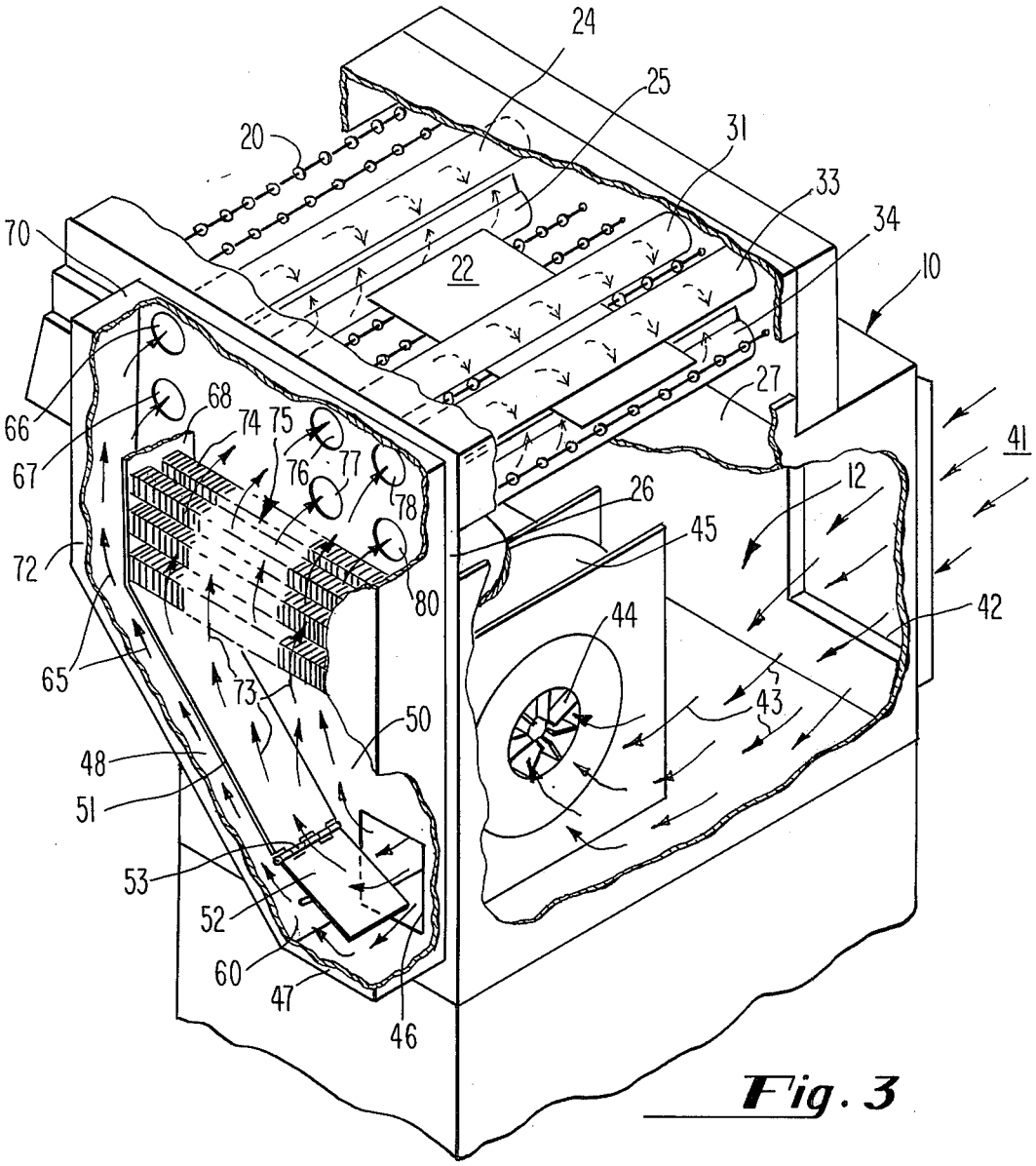
FIG. 3 is a fragmentary top perspective view of apparatus in accordance with the present invention, with portions of the chamber and duct broken away for the sake of clarity.

A pair of cool air knives 24 and 25 traverse the inside of the chamber 13, from side 26 to side 27, as illustrated in FIG. 3, with the knives 24 and 25 being carried by the side walls 26 and 27.

The air knives are all of similar construction, each having a backwardly or rearwardly directed discharge opening 28 or 30 to impel air delivered thereto onto surfaces of articles 22 traveling therepast, in such a way as to blow droplets of water or other liquid therefrom, and in a rearward direction relative to the direction of movement of articles 22. The air knives 28 or 30, for example, are of a conventional type and provide a screen of air of the desired flow, sufficiently forceful to blow droplets off the articles. The air knives 24 and 25 are referred to in this application as "cool air knives."

Closer to the discharge end 15 of the chamber 13 there are provided two pairs of air knives 31, 32, and 33, 34, constructed similarly to the air knives 24 and 25, and operationally similar to some degree, also.

A water outlet port 35 with a discharge hose 36 connected thereto is provided for a discharge of the water or liquid thus blown off from the floor 17 of the chamber 13.

In the middle zone 12 of the apparatus 10, there is provided a suitable electric motor or the like 37, base mounted at 38, for driving a turbine or a blower 40 for delivering air to be channeled into the air knives 24, 25, 31, 32, 33, and 34.

With reference to FIG. 3, it will be seen that air is delivered from the ambient 41, into middle section 12 of the apparatus 10 through an opening 42, to follow the paths indicated by the arrows 43, into the inlet 44 of the turbine or other suitable blower 45, with this air then being impelled or otherwise suitably delivered to the discharge 46 of the blower, into a duct 47 located externally of the side wall 26. The duct 47 is divided into an unheated or cool air channel 48 and a heated air channel by means of a separator 51. A deflection plate 52 is provided, pivotally carried by means of a piano hinge 53 or the like by the lower end of the sloped separator plate 51 as illustrated in FIG. 3, with the deflection plate 52 being adjustably positionable at an infinite number of positions within its range of movement, in the directions illustrated by the double-headed arrow 54 in FIG. 4.

Figure 4:
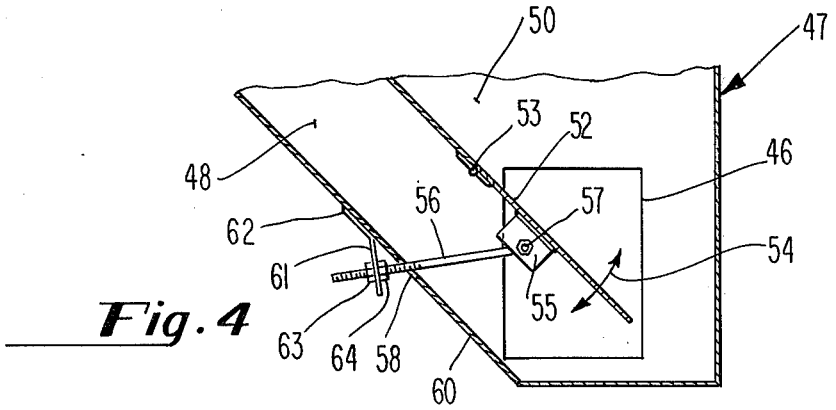
FIG. 4 is an enlarged fragmentary vertical sectional view, taken through a portion of the duct illustrated in FIG. 3, wherein the adjustable deflection plate and outside adjustment device therefore is clearly illustrated.

The deflection plate 52 is provided with a bracket 55 carried thereby, with an adjustment member 56 pivotally connected to and carried by the bracket 55 at 57. The member 56 is threaded at its left-most end, and passes through an opening 58 in the sloped wall 60 of the duct 47, with its left-most end being adjustably carried by a bracket 61 that in turn is fixedly carried by the wall 60 of the duct at 62. Outside and inside nuts 63 and 64 are suitable threaded onto the threaded end of the member 56 as illustrated in FIG. 4, and each of these may be adjustably positioned therealong, to locate the deflection plate 52 at any desired angular orientation within its range of movement, by pivoting the same along the piano hinge 53.

Accordingly, incoming air through the opening 46 will be delivered into either the channel 48 or the channel 50. The incoming air that is delivered to the channel 48 follows the direction of the arrows 65 of FIG. 3, to be delivered to the air knives 24 and 25 through end openings 66 and 67 respectively. It will be noted at this point that upper end portion 68 of separator plate 51, while being illustrated fragmentally in FIG. 3 for the sake of clarity, extends vertically upwardly to engage the upper wall 70 of the duct, in order to prevent passage of the cool, non-heated air from the channel 48, across the separator 51, into the channel 50. Similarly, the separator 51 extends from the wall 26 of the apparatus, outwardly to the wall 72 of the duct.

A portion of the air being delivered into the duct 47 is deflected by means of the deflection plate 52, to follow the paths indicated for the arrows 73, around the many fins 74 of the heater 75, for heating of the air to some desired predetermined temperature that may be set for operation of the electric or other suitable heater 75, whereby heated air will be delivered into the air knives 31, 32, 33, and 34 through the end opening 76, 77, 78, and 80.

It will be apparent that th heaters 75 may be of any suitable type, but electrical heaters are preferred. It will also be apparent, that while the principal part of the description is in terms of using the device as air knives for delivery of air for blowing water off articles being treated and for drying water remnants, in its broadest terms, the device may employ any gas, for blowing-off and drying any liquid carried by articles to be dried.

Figure 2:
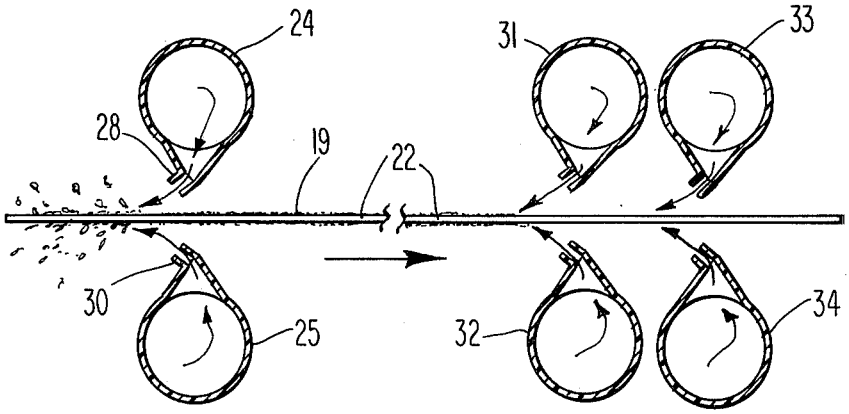
FIG. 2 is an enlarged fragmentary vertical sectional view of an article being treated and the air knives doing the treating, wherein a portion of the illustration of FIG. 1 is more clearly set forth.

With specific reference to FIG. 2, it will be seen that a member being treated thereby has cool or unheated air directed rearwardly of a forwardly moving article 22, for blowing droplets of air from the printed circuit board or other suitable article as illustrated, leaving generally thin film 19 on the board. This film 19 is then dried as the article 22 passes between the pair of air knives 31, 32 and preferably through a second pair of hot air knives 33, 34, whereby evaporation of residual moisture and prevention of condensation from any moisture in the ambient is effected.

For different articles, it will be apparent that the air knives may be pair closer to or farther away from each other, as desired.

It will apparent that various modifications may be made in the details of construction, as well as the use of the apparatus of the present invention, all within the spirit and scope of the appended claims.

What is claimed is:

1. Apparatus for drying treated articles following treatment of the articles in such a way that liquid substance remains on the articles, comprising a chamber means, conveyor means in said chamber means for receiving articles with liquid substance on at least one of their surfaces at an inlet of said chamber means and for conveying articles through said chamber means in a forward direction for discharge at an outlet of said chamber means, and gas knife means for drying the articles by removing the liquid substance from the articles through a serial combination of physical impelling and evaporation, wherein said gas knife means comprises first gas knife means located in said chamber means along said conveyor means, for delivering a sufficiently forceful stream of gas at a cooler temperature, substantially unheated by the apparatus, for blowing liquid substance from the articles, and second gas knife means located in said chamber means along said conveyor means for delivering a sufficiently forceful stream of gas at a warmer temperature, heated by said apparatus, for evaporating residual liquid film from the articles; said apparatus including means for supplying gas to said first and second gas knife means and means for heating gas being supplied to said second gas knife means, wherein said means for supplying gas includes a duct and wherein said duct is provided with first and second channels; said first channel being connected for delivering gas to said first gas knife means and said second channel being connected for delivering gas to said second gas knife means, with said heating means being disposed in said second channel for heating the gas by the flow of gas therepast, wherein flow controller means is provided in said duct means for altering the relative proportions of gas being provided to said first and second channels.

2. Apparatus for drying treated articles following treatment of the articles in such a way that liquid substance remains on the articles, comprising a chamber means, conveyor means in said chamber means for receiving articles with liquid substance on at least one of their surfaces at an inlet of said chamber means and for conveying articles through said chamber means in a forward direction for discharge at an outlet of said chamber means, and gas knife means for drying the articles by removing the liquid substance from the articles through a serial combination of physical impelling and evaporation, wherein said gas knife means comprises first gas knife means located in said chamber means along said conveyor means, with associated first gas discharge opening means facing rearwardly for delivering a sufficiently forceful stream of gas at a cooler temperature, substantially unheated by the apparatus, for blowing liquid substance from the articles in a rearward direction relative to the forward direction of articles being conveyed therepast, and second gas knife means located in said chamber means along said conveyor means forward of said first gas knife means, said second gas knife means having associated second gas discharge opening means facing rearwardly for delivering a sufficiently forceful stream of air at a warmer temperature, heated by said apparatus, for evaporating residual liquid film from the articles; said apparatus including means for supplying gas to said first and second gas knife means and means for heating gas being supplied to said second gas knife means, wherein the means for delivering gas comprises means for delivering air, wherein said gas knife means comprises air knife means, and wherein said gas knife means for removing liquid substance by evaporation comprises means for removing water by evaporation, wherein said means for supplying gas comprises blower means for supplying air to a duct and wherein said duct is provided with first and second channels; said first channel being connected for delivering air to said first gas knife means and said second channel being connected for delivering air to said second gas knife means, with said heating means being disposed in said second channel for heating the air by the flow of air therepast, wherein flow controller means is provided in said duct means for altering the relative proportions of air being provided to said first and second channels.

3. The apparatus of claim 2, wherein said flow controller means comprises a deflector plate pivotally mounted on a separator wall that separates the inlets to said channels for pivotal movement of said plate.

4. The apparatus of claim 3, including manually actuable adjustment means connected to said deflector plate and extending of said apparatus for adjustment of plate position from outside the channels.

5. The method of drying wet articles comprising the step of delivering the articles into a chamber, and moving the articles through the chamber from an inlet to an outlet thereof, drawing ambient air from a room, generally at room temperature, by means of an impeller, dividing the air delivered by the impeller into parallel portions, the first portion of which is to be delivered in unheated form to air knives, and a second portion of which is to be delivered over a heater to other air knives, simultaneously delivering the two portions of air to their respectively associated air knives, while heating the air in the portion that is to be delivered to hot air knives, delivering articles to be treated past the air knives having the unheated air therein with the unheated air being delivered sufficiently forcefully to blow liquid from the articles passing thereby, and continuing the delivery of articles through the chamber to the air knives having heated air delivered thereto, and evaporating any residual mositure remaining on the articles by means of the heated air delivered through their air knives, with the air knives in each instance providing an air screen or curtain through which articles being dried must pass, including the step of adjusting the relative air distribution between the portion that delivers unheated air and the portion that delivers heated air to the air knives, by means of effecting a manual adjustment from outside the zone of air delivery to adjust the position of a deflection plate.

* * * * *

UNITED STATES PATENT OFFICE

CERTIFICATE OF CORRECTION

Patent No. 4,017,982 Dated April 19, 1977

Inventor(s) Daniel L. Goffredo

It is certified that error appears in the above-identified patent and that said Letters Patent are hereby corrected as shown below:

Column 5, line 4, "th" should read --the--;

Column 6, line 50, after "plate and extending" insert --externally--.

Signed and Sealed this

*second* Day of *August 1977*

[SEAL]

*Attest:*

RUTH C. MASON
*Attesting Officer*

C. MARSHALL DANN
*Commissioner of Patents and Trademarks*